US006011574A

United States Patent [19]

Tazaki et al.

[11] Patent Number: 6,011,574

[45] **Date of Patent: *Jan. 4, 2000**

[54] LINE THERMAL HEAD PRINTER APPARATUS

[75] Inventors: Ribun Tazaki; Masuo Sogabe, both of Fuchu, Japan

[73] Assignee: Daisey Kikai Co., Ltd., Tsurugashima, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/886,476

[22] Filed: Jul. 1, 1997

[51] Int. Cl.[7] ..... B41J 33/14

[52] U.S. Cl. ..... 347/217

[58] Field of Search ..... 347/171, 184, 347/197, 217, 215, 218; 400/232

[56] References Cited

U.S. PATENT DOCUMENTS

| | | | |
|---|---|---|---|
| Re. 33,496 | 12/1990 | Matsuno et al. | 347/184 |
| 4,879,566 | 11/1989 | Hanabusa | 347/198 |
| 4,916,560 | 4/1990 | Kawaguchi | 360/73.09 |
| 5,647,679 | 7/1997 | Green et al. | 400/232 |

*Primary Examiner*—N. Le
*Assistant Examiner*—Anh T. N. Vo
*Attorney, Agent, or Firm*—Oblon, Spivak, McClelland, Maier & Neustadt, P.C.

[57] ABSTRACT

In a line thermal head printer apparatus, a ribbon tape is moved, only while printing is to be made, synchronously with the moving velocity of the object to be printed. The ribbon tape is moved only by the amount needed for printing and the amount of use of the ribbon tape is reduced and yet a beautiful printing is made. Ribbon tape 2 unwound from a heat transfer ribbon tape master roll 1 is lapped with a packaging material film 8 on a platen roller 6 and printing is made by a line thermal head 5 on the packaging material film 8. The ribbon tape 2 is stopped by a braking action making use of a maximum static torque characteristic of a stepping motor until a portion to be printed of the packaging material film 8 approaches, and is moved by the stepping motor only when the portion to be printed of the packaging material film 8 arrives. With a signal from an detector 10 to detect a velocity of the packaging material film 8, the stepping motor moves the ribbon tape 2 at a velocity always synchronized with the velocity of the packaging material film 8 and a beautiful printing is made at a predetermined place.

4 Claims, 5 Drawing Sheets

$$\frac{\phi_1 \times \pi}{\text{ENCODER RESOLVING ABILITY}} \times n = \frac{\phi_2 \times \pi}{\text{STEPPING MOTOR RESOLVING ABILITY}} \quad \text{--- (1)}$$

LINE THERMAL HEAD PRINTER APPARATUS

BACKGROUND OF THE INVENTION

1. Field of the Invention

The present invention relates to a line thermal head printer apparatus in which a line thermal head is supplied with electricity to print on a moving object to be printed, using a ribbon tape (carbon tape).

2. Description of the Related Art

In recent years, there have been many cases where printing of letters and marks, such as date of manufacture, tastable time period, series number of manufacture, etc. on a packaging material for example, have been required to be made on the object to be printed, and for this kind of printing, a line thermal head printer apparatus is often used.

In the conventional line thermal head printer apparatus, a ribbon tape of the same length as the moving length of the object to be printed, such as a film supplied from a master roll, is fed with the same velocity as the moving object to be printed. In this type of line thermal head printer apparatus, a large amount of the expensive ribbon tape is consumed, and so there is a need to reduce the amount of ribbon tape which is used. There has therefore been proposed a device in which a ribbon tape is moved only during printing, and is otherwise stopped.

The velocity of the ribbon tape should always be the same as the object being printed during a printing operation. However, when the movement of the ribbon tape is commenced upon the approach of the portion to be printed of the object to be printed, some rise time is required until the ribbon tape reaches the velocity of the moving object. Moreover, the transfer velocity of the object to be printed varied slightly. Thus there occurs a deviation in the relative position of the object to be printed and the ribbon tape, and a print is not always cleanly applied to a predetermined part of the object to be printed.

SUMMARY OF THE INVENTION

It is therefore an object of the present invention to provide a line thermal head printer apparatus in which a ribbon tape is moved only during printing on an object to be printed, so that the amount of use of the ribbon tape is remarkably reduced, a rise time of the ribbon tape is short enough and yet the ribbon tape is moved at a velocity always synchronized with the moving velocity of the object to be printed, thereby clean printing can be made.

In order to attain this object, the present invention provides a line thermal head printer apparatus comprising a velocity detector device to detect a moving velocity of the object to be printed, and a stepping motor to move a ribbon tape only while printing is to be done on the object to be printed, at a velocity synchronized with the moving velocity of the object to be printed detected by said detector device.

In the line thermal head printing apparatus according to the present invention, while a portion not to be printed of the object to be printed is moving, the movement of the ribbon tape is stopped by the stepping motor as a brake, and only when a portion to be printed of the object to be printed approaches is the movement of the ribbon tape commenced by the stepping motor with a good rise time. The stepping motor is rotated at a speed synchronized with the velocity of the moving object to be printed detected by the velocity detector device to detect the velocity of the moving object to be printed, and moves the ribbon tape at a velocity always synchronized with the velocity of the moving object to be printed, and the ribbon tape is moved at a velocity always synchronized with the object to be printed even if the moving velocity of the moving object to be printed varies. This is partly assisted by frictional adhesion resistance and static electricity between the object to be printed and the ribbon tape. Thus, high quality printing can be applied to the place to be printed.

As a printing apparatus in which the ribbon tape is moved only during printing on the object to be printed, at a velocity synchronized with the velocity of the moving object to be printed and printing is made by a thermal head, as mentioned above, the present invention further provides a line thermal head printer apparatus comprising a presser element to press the thermal head constantly against the object to be printed, a ribbon tape driving device to move the ribbon tape, at the time of printing, at a velocity synchronized with the object to be printed and a knock cylinder to apply an instantaneous pressing force on said presser element at the time of printing. According to said printer apparatus, while the portion not to be printed of the object to be printed is being transferred, the ribbon tape, being only pressed against the object to be printed by the presser element, does not move and the object to be printed is transferred slidingly on the surface of the ribbon tape.

Upon the approach of the portion to be printed of the object to be printed, the ribbon tape is moved at a velocity synchronized with the object to be printed by the appropriate means as mentioned above and an instantaneous pressing force is added to the presser element by the knock cylinder. Thus, without a shock such as the added pressing force given by the descent of the thermal head, a clean printing can be made on the portion to be printed of the object to be printed. As mentioned above, according to the present invention, there is provided a line thermal head printer apparatus in which a ribbon tape is moved only by a length necessary for heat transfer printing, the amount of the ribbon tape is remarkably saved, and even if the moving velocity of the object to be printed varies, the ribbon tape is moved at a velocity always synchronized with the object to be printed.

DESCRIPTION OF THE PREFERRED EMBODIMENT

Hereinbelow, a line thermal head printer apparatus according to the present invention is described concretely with reference to the figures.

Figure 1:
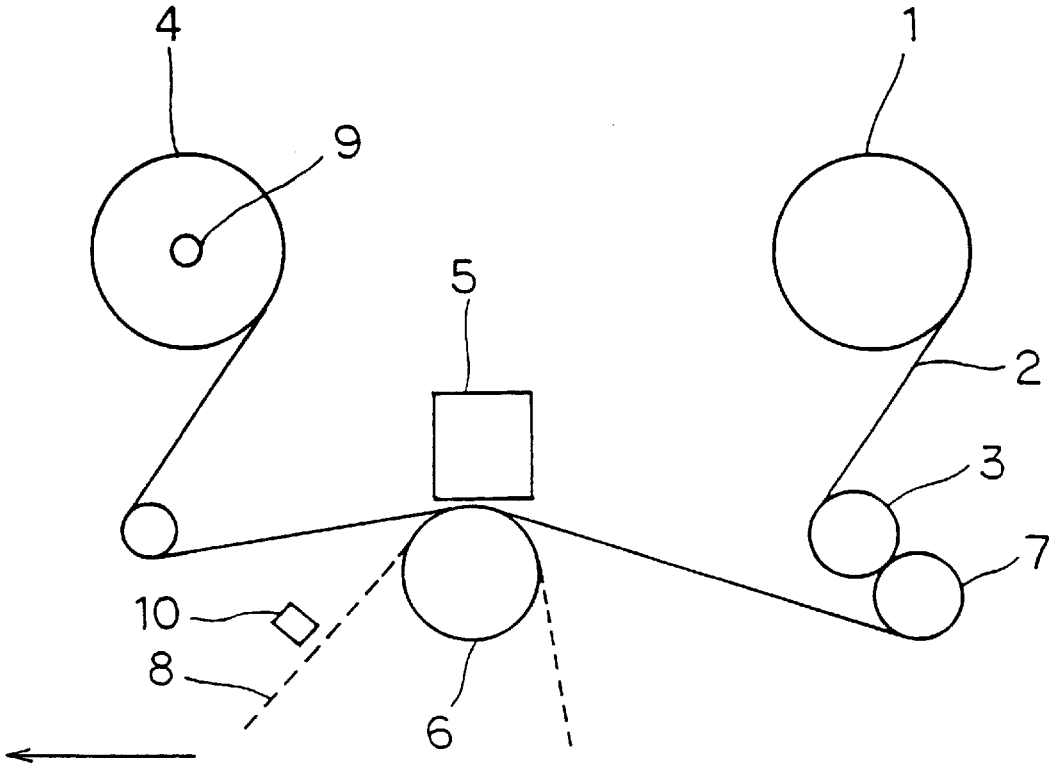
FIG. 1 is an explanatory view showing a line thermal head printer apparatus of one preferred embodiment according to the present invention.

FIG. 1 shows a line thermal head printer apparatus of preferred embodiment according to the present invention, wherein numeral 1 designates a master roll of ribbon tape of the heat transfer type. The unwound ribbon tape 2, after being used for printing as described below, is wound around a used tape winding roll 4 fitted on a shaft 9 of a D.C. torque motor. A line thermal head 5 and a head receiving platen roller 6 are arranged to face each other. Between the line thermal head 5 and the head receiving platen roller 6 are overlappingly passed the ribbon tape 2 from the master roll 1 and an object to be printed, e.g., a packaging material film 8, and a predetermined printing is applied to the packaging material film 8. A stepping motor driven roller 3 is stopped while printing is not being made on the packaging material film 8 and is used to brake the ribbon tape 2, making use of its maximum static torque characteristic. Numeral 7 designates a ribbon tape pressing roller. Numeral 10 designates an velocity detector to detect a transfer velocity of the packaging material film 8, and the rotational speed of the stepping motor is controlled by rotational speed by the detection thereof.

As the line thermal head printer apparatus so constructed, when no printing is necessary on the packaging material film 8, which is an object to be printed, the stepping motor is stopped and is used to brake the ribbon tape 2, making use of its maximum static torque characteristic, and so the ribbon tape 2 is also stopped. When a portion to be printed of the packaging material film 8 approaches the gap between the line thermal head 5 and the head receiving platen roller 6, a moving velocity signal from the velocity detector 10 is used to control the stepping motor to move the ribbon tape 2 at a velocity synchronized with the transfer velocity of the packaging material film 8, and the line thermal head 5 is supplied with electricity so that printing is performed using the ribbon tape 2.

The ribbon tape 2 is thus moved at a velocity synchronized with the transfer velocity of the packaging material film 8, partly assisted by frictional adhesion to the packaging material film 8 and static electricity. Thus the ribbon tape 2 is efficiently used and high quality printing can be done.

Figure 2:
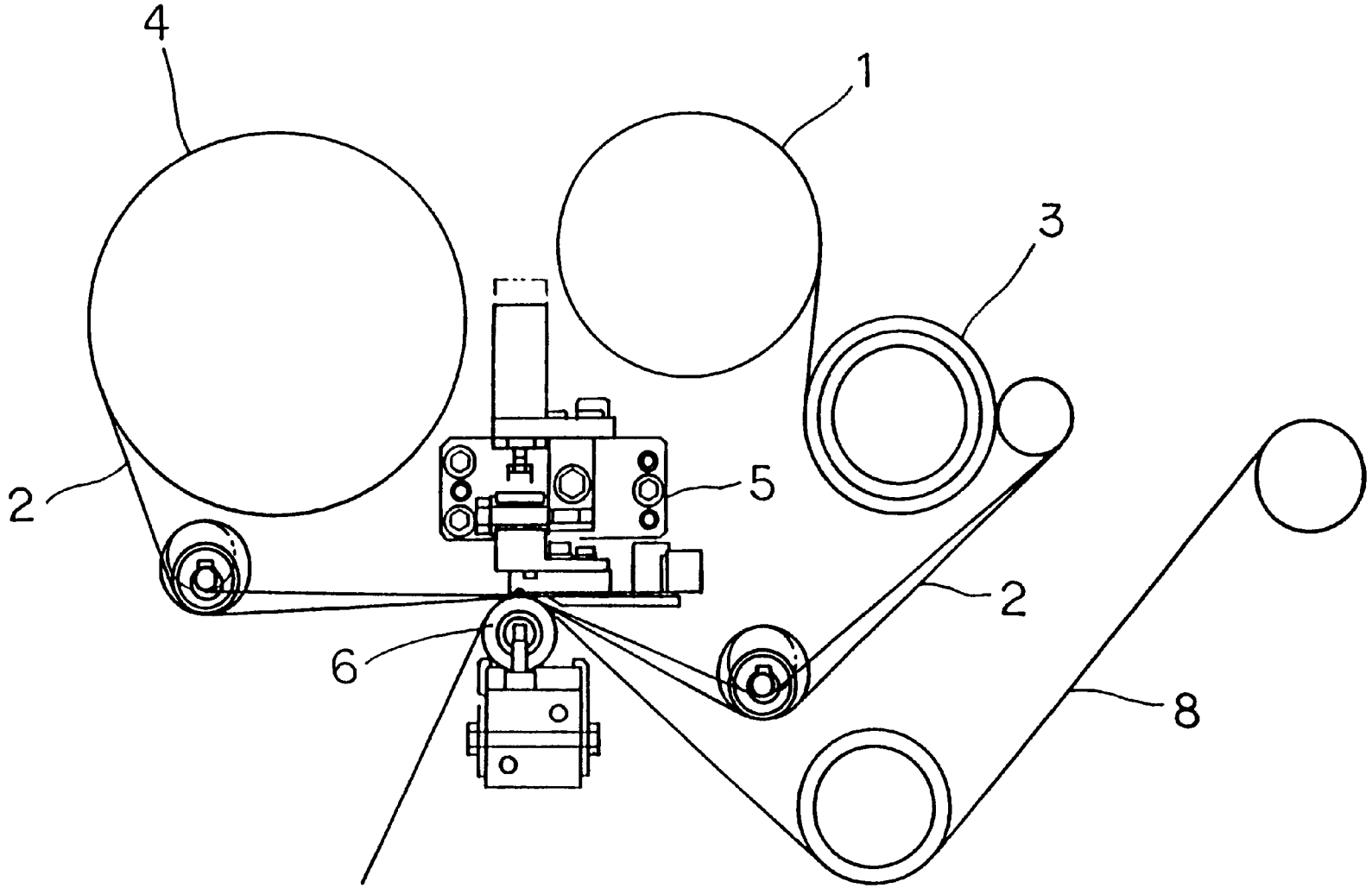
FIG. 2 shows the construction of a printing portion of FIG. 1.
Figure 3:
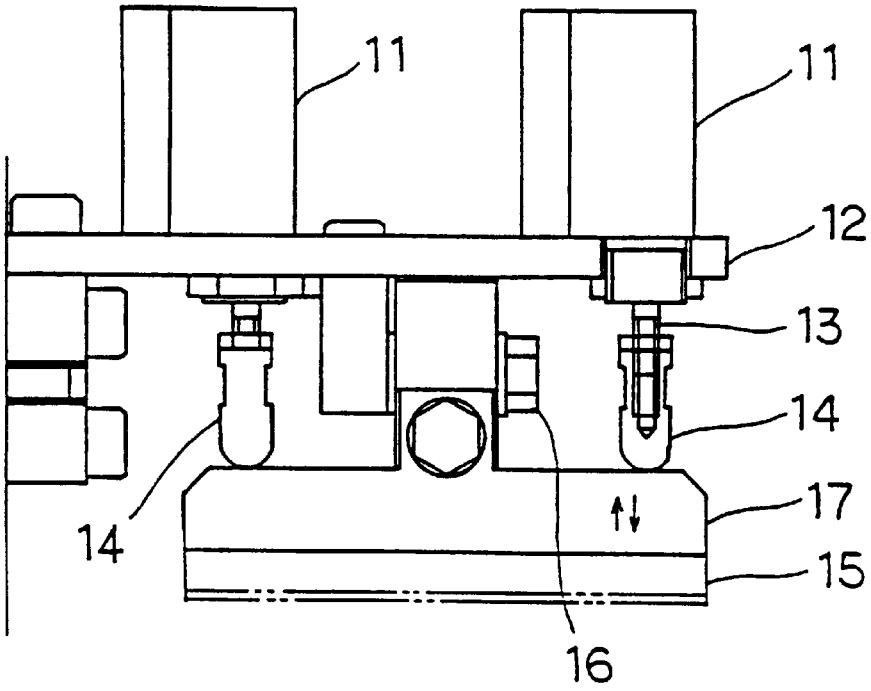
FIG. 3 is a front view showing construction of a line thermal head portion of FIG. 2.
Figure 4:
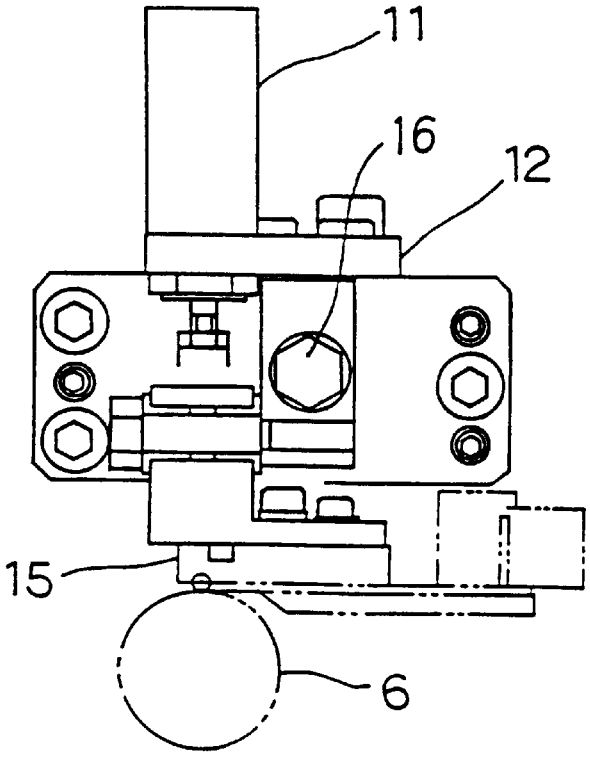
FIG. 4 is a side view of FIG. 3.

One example of concrete construction of said line thermal head 5 is shown in FIGS. 2 to 4. In FIGS. 2 to 4, a knock cylinder 11 of the thermal head is fitted to a fitting plate 12, a piston rod 13 of which is provided with a presser element 14. A thermal head 15 is fitted cantileverwise rotatably around a pin 16 via a head fitting plate 17 so as to be movable up and down as shown by arrows of FIG. 3. The thermal head 15 is positioned to face the platen roller 6 with the ribbon tape always pressed against the packaging material film 8 by the weight of the thermal head 15 (about 1.2 $kg/cm^2$ as one example). While a portion not to be printed of the packaging material film 8 is being moved, the ribbon tape 2 is stopped and the packaging material film 8 is transferred slidingly on the surface of the ribbon tape 2. Upon the approach of the portion to be printed of the packaging material film 8, the ribbon tape 2 is fed by the stepping motor 3 and is wound by the D.C. torque motor, thereby the ribbon tape is moved at a velocity equal to that of the packaging material film 8.

At the same time, the knock cylinder 11 is operated so that the ribbon tape 2, which is being pressed against the packaging material film 8 by the weight of the thermal head 15, is and printing is performed.

Upon the printing being finished, the pressure of the knock cylinder 11 is relaxed and the ribbon tape 2 returns to a state in which it is pressed against the packaging material film 8 by only the weight of the thermal head 15. Thus the ribbon tape 2, as it is being pressed against the packaging material film 8, is pushed to print only at the time of pressing by the knock cylinder 11, and printing without an impact force on the ribbon tape 2 or the packaging material film 8 can be made.

Figure 5:
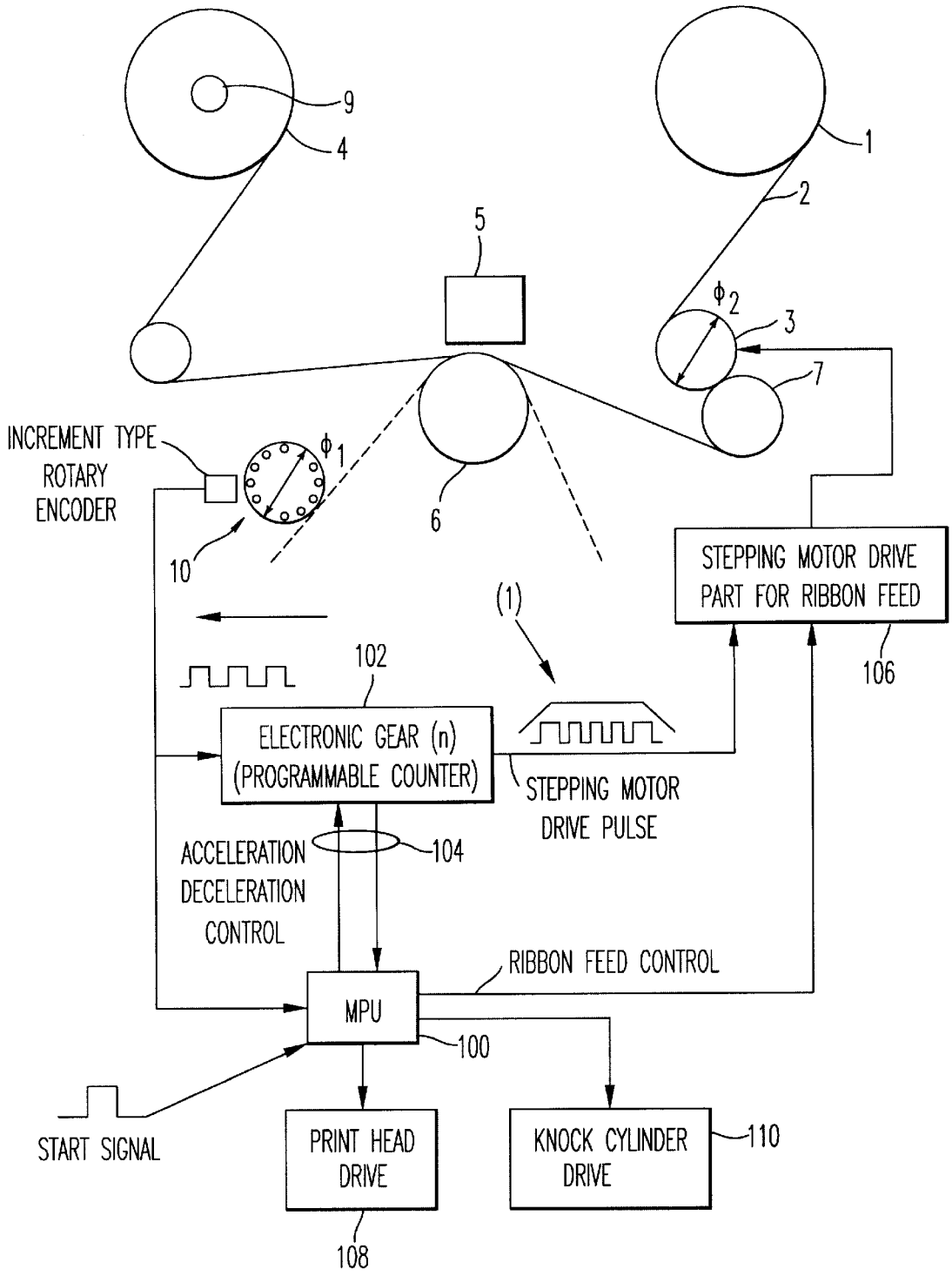
FIG. 5 schematically shows the control system for the stepping motor and the knock cylinder.

Referring more particularly to FIG. 5, the velocity detector 10 is an increment type rotary encoder which presses against the moving film 8 and is thus rotated to produce a square wave type output. In other words, the velocity detecting encoder is configured to output a pulse for every predetermined length of object passed by the velocity detecting encoder 10. The signal from the encoder 10 is fed to an electronic gear 102 and MPU (processor) 100. MPU 100 surveys the signal from the encoder 10 and, when it receives a start signal of printing, it sends a gate signal to the electronic gear 102 to open it for the necessary time interval for printing predetermined marks on the object 8 to be printed.

The electronic gear 102 allows the pulse signal from the encoder 10 to pass to the stepping motor drive part for ribbon feed 106 for the time interval indicated by the gate signal from the MPU 100.

In this case, the electronic gear 102 acts to accelerate or decelerate the signal from the encoder 10 so that the pulse signal given to the stepping motor drive part for ribbon feed 106 is added with an inclination for slowing-up or slowing-down as shown by (1) in FIG. 5.

Owing to the above operations of MPU 100 and the electronic gear 102, the pulse signal from the encoder 10 is sent to the stepping motor drive part for ribbon feed 106 via the electronic gear 102 during the time interval necessary to print designed marks on the film 8 corresponding to the file velocity detected by the encoder 10.

The moving amount per one pulse detected by the encoder 10 and that of the ribbon tape fed by the stepping motor drive 106 are selected to become same. In other words, the stepping motor drive unit 106 is configured to control the stepper motor 3 so as to move the ribbon tape a predetermined length per pulse signal received from the velocity detector which is equal to the predetermined length per pulse signal generated by the velocity detector, thereby the stepping motor moves the ribbon tape at a velocity synchronized with the velocity of the moving object to be printed.

Therefore, when the pulse signal from the encoder 10 is fed to the stepping motor drive part for ribbon tape 106, the stepping motor 106 feeds the ribbon tape 2 at a velocity synchronized with the moving velocity of the film 8, thereby, a predetermined printing is obtained. The MPU, which receives a print start signal, also activates the print head drive 108 and the knock cylinder drive 110 in coordination with the ribbon feed.

Figure 6:
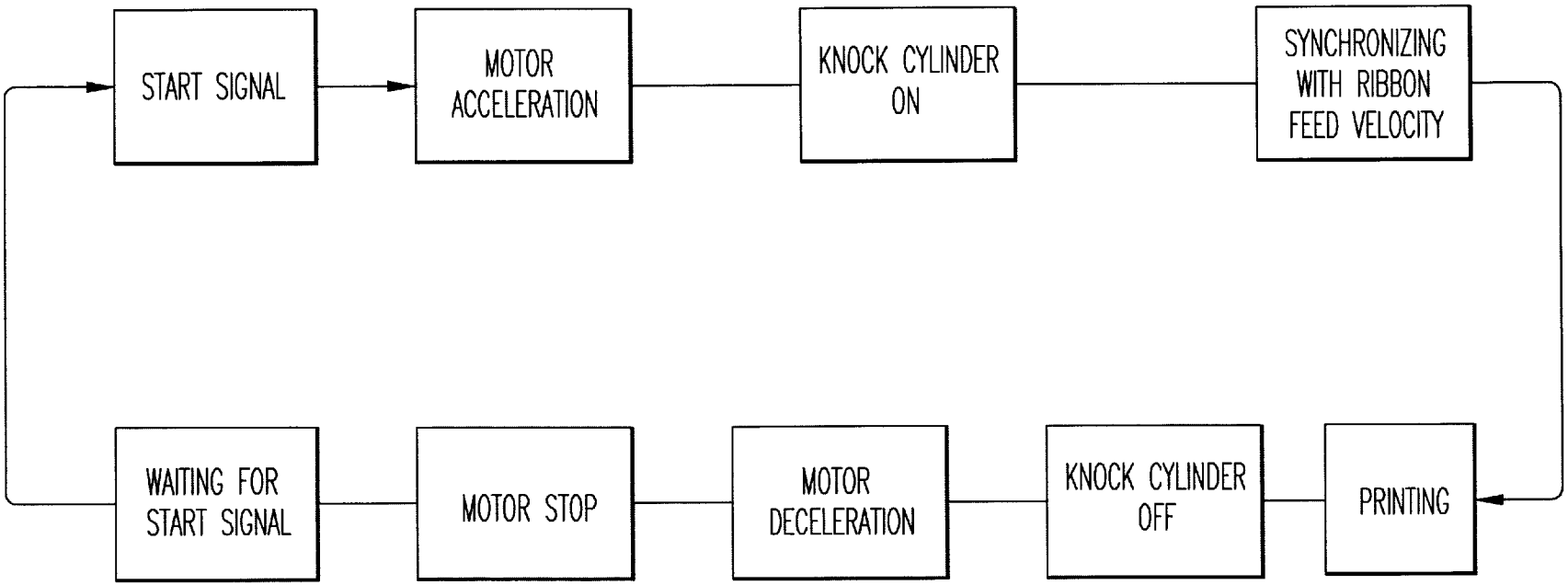
FIG. 6 is a flow chart of the control of the stepping motor and the knock cylinder.

Referring to the flow chart of FIG. 6, a start signal begins acceleration of the stepping motor 3 via the motor drive unit 106. The knock cylinder is applied via the knock cylinder drive 110 and the ribbon tape velocity is synchronized with that of the film 8. Printing is then performed, after which the knock cylinder is relaxed, and the stepping motor is decelerated and stopped. The system then awaits a further start signal.

As mentioned above, according to the present invention the ribbon tape is controlled to move only for the portion to be printed of the object to be printed, synchronously with the moving velocity of the object to be printed, and the line thermal head is supplied with electricity to print. Thus the ribbon tape is transferred efficiently, corresponding to the object to be printed and an economical and high quality printing can be made.

While the preferred form of the present invention has been described, variations thereto will occur to those skilled in the art within the scope of the present inventive concepts which are delineated by the following claims.

What is claimed is:

1. A line thermal head printer apparatus in which printing is performed on a moving object to be printed by use of a thermal head and a ribbon tape, comprising:

a velocity detector to detect a velocity of the moving object to be printed, said velocity detector configured to output a pulse signal for every predetermined length of object passed by said velocity detector;

a stepping motor drive unit responsive to said pulse signal from said velocity detector and configured to control a stepper motor to move the ribbon tape, said stepping motor drive unit receiving the signal from said velocity detector via an electronic gear; and a processor electrically connected to said electronic gear and said velocity detector, for sending a gate signal to the electronic gear in responding to said pulse signal when printing is to be performed;

wherein said stepping motor drive unit is configured to control to the stepper motor so as to move the ribbon tape a predetermined length per pulse signal received from said velocity detector which is equal to the predetermined length per pulse signal generated by said velocity detector, thereby the stepping motor moves the ribbon tape at a velocity synchronized with the velocity of the moving object to be printed.

2. A line thermal head printer apparatus according to claim 1, further comprising:

a presser element to press the thermal head constantly against the object to be printed via the ribbon tape; and a knock cylinder having an instantaneous pressing force and acting on said presser element during printing.

3. A line thermal head printer apparatus in which printing is performed on a moving object to be printed by use of a thermal head and a ribbon tape, comprising:

a velocity detector configured to detect a velocity of the moving object to be printed and generate a signal corresponding to the moving velocity of the object to be printed, wherein said signal comprises a pulse for each predetermined length of the object to be printed that passes by said velocity detector;

a stepping motor drive unit responsive to said signal from said velocity detector and configured to control a stepper motor so as to move the ribbon tape, said stepping motor drive unit receiving the signal from said velocity detector via an electronic gear; and a processor electrically connected to said electronic gear and said velocity detector, for sending a gate signal to the electronic gear in responding to said pulse signal when the printing is to be performed; wherein said stepping motor drive unit is configured so that the stepping motor moves the ribbon tape a distance equal to the predetermined length for every pulse received from said velocity detector, thereby moving the ribbon tape at a velocity synchronized with the velocity of the moving object to be printed.

4. A line thermal head printer apparatus according to claim 3, further comprising:

a presser element to press the thermal head constantly against the object to be printed via the ribbon tape; and a knock cylinder having an instantaneous pressing force and acting on said presser element during printing.

* * * * *